US005506943A

United States Patent [19]

Furukawa

[11] Patent Number: 5,506,943

[45] Date of Patent: Apr. 9, 1996

[54] IMAGE FORMING APPARATUS HAVING AUTOMATIC PRINTING FUNCTION

[75] Inventor: Satoshi Furukawa, Suzuka, Japan

[73] Assignee: Brother Kogyo Kabushiki Kaisha, Nagoya, Japan

[21] Appl. No.: 50,618

[22] Filed: Apr. 22, 1993

[30] Foreign Application Priority Data

Jul. 10, 1992 [JP] Japan ..... 4-183810

[51] Int. Cl.[6] ..... G03G 15/00

[52] U.S. Cl. ..... 395/113

[58] Field of Search ..... 395/113, 112, 395/101; 340/679; 283/79

[56] References Cited

U.S. PATENT DOCUMENTS

| | | | |
|---|---|---|---|
| 4,682,158 | 7/1987 | Ito et al. | 340/679 |
| 4,797,704 | 1/1989 | Williams et al. | 355/3 |
| 4,994,986 | 2/1991 | Cihiwsky et al. | 395/113 |
| 5,068,806 | 11/1991 | Gatten | 395/113 |
| 5,071,167 | 12/1991 | O'Brien | 283/79 |
| 5,255,054 | 10/1993 | Tsai | 395/112 |
| 5,340,158 | 8/1994 | Bartl | 283/81 |

FOREIGN PATENT DOCUMENTS

| | | | |
|---|---|---|---|
| 0210752 | 2/1987 | European Pat. Off. . | |
| 0438160 | 7/1991 | European Pat. Off. | G03G 15/00 |
| 3836890A1 | 5/1989 | Germany . | |

*Primary Examiner*—Mark R. Powell
*Assistant Examiner*—Steven P. Sax
*Attorney, Agent, or Firm*—Oliff & Berridge

[57] ABSTRACT

When a process unit of the image forming apparatus has reached the end of its service life, the apparatus prints recovery information on a sheet, such as an officially approved "postage paid" mark, a recipient's name, the recipient's address and the recipient's postal code. The printed information tells the user that the service life of the process unit has expired, that the unit is a consumable component to be recovered for recycling, and that the unit is to be returned to the designated address.

20 Claims, 5 Drawing Sheets

10
111
110
EXTERNAL APPARATUS
100
EXTERNAL APPARATUS
101
OPERATION PANEL
124
CASSETTE DETECTOR
125
I/F
120
I/F
119
ROM
114
P·I/F
122
ROM
115
RAM
117
V·I/F
121
CPU
113
RAM
116
TIMING CONTROL CIRCUIT
118
123
DC CONTROLLER CIRCUIT
112
LASER DIODE
132
SCANNER MOTOR
133
CHARGE CONTROL UNIT
129
POWER SUPPLY CIRCUIT
128
HEATER DRIVE CIRCUIT
127
FIXING HEATER
131
MAIN MOTOR DRIVING CIRCUIT
126
MAIN MOTOR
130

IMAGE FORMING APPARATUS HAVING AUTOMATIC PRINTING FUNCTION

BACKGROUND OF THE INVENTION

1. Field of the Invention

The invention relates to an image formation apparatus that promotes the recovery of consumables contained therein for recycling purposes.

2. Description of the Related Art

Heretofore, almost all consumables or products that became unusable or no longer needed have been discarded as trash. But today, with the growing interest in environmental protection, the trend towards recycling of used resources has developed, the emphasis being on how to deal properly with toxic materials contained in the consumables with a view to minimizing environmental pollution.

Amid the growing public demand for recovering and recycling products and consumables, some users have started sending them back to their manufacturers, the shipping expenses paid either by the users or by agents of the manufacturers. The heightened attention paid to the responsibility of those who supply industrial goods has prompted some manufacturers to minimize the toxic materials going into their products. Some manufacturers have started recovering, free of charge, their products or the consumables contained therein for recycling purposes.

However, most of today's schemes for waste product recovery are slow to receive widespread acceptance because they are too costly for users to implement. Another problem with the recycling schemes is that even where manufacturers have set up recycling channels, the cost involved is too high or most users are unaware of such channels and go on discarding the used products.

SUMMARY OF THE INVENTION

It is therefore an object of the invention to solve the above problems, to overcome difficulties and to provide an image formation apparatus that promotes, in an easy-to-understand manner, the recovery and recycling of consumables contained in the apparatus with a minimum of cost and effort required on the user's part.

In carrying out the invention and according to one aspect thereof, there is provided an image formation apparatus having an image process unit for forming visible images on a photosensitive body and transferring them onto a transfer material for image recording thereon, the apparatus comprising: counting means for counting the number of times the images are recorded; storage means for storing data including the destination to which to send recovered consumables; and control means for causing a predetermined image to be recorded onto the transfer material in accordance with the data in the storage means when the counting means has reached a predetermined recording count.

The image formation apparatus, having the structure outlined above, records an image on the transfer material showing the destination and other relevant information necessary for the consumables to be recovered. The image is recorded in accordance with the data in the storage means when the counting means has reached the predetermined recording count. A simple look at the transfer material informs the user which consumables are to be recovered and where the consumables are to be sent for recycling. This scheme significantly increases the rate of recovery of consumables.

These and other objects, features and advantages of the invention will become more apparent upon a reading of the following description and appended drawings.

DESCRIPTION OF THE PREFERRED EMBODIMENT

The preferred embodiment of the invention, used in the form of a laser printer, will be described with reference to the accompanying drawings.

Figure 1:
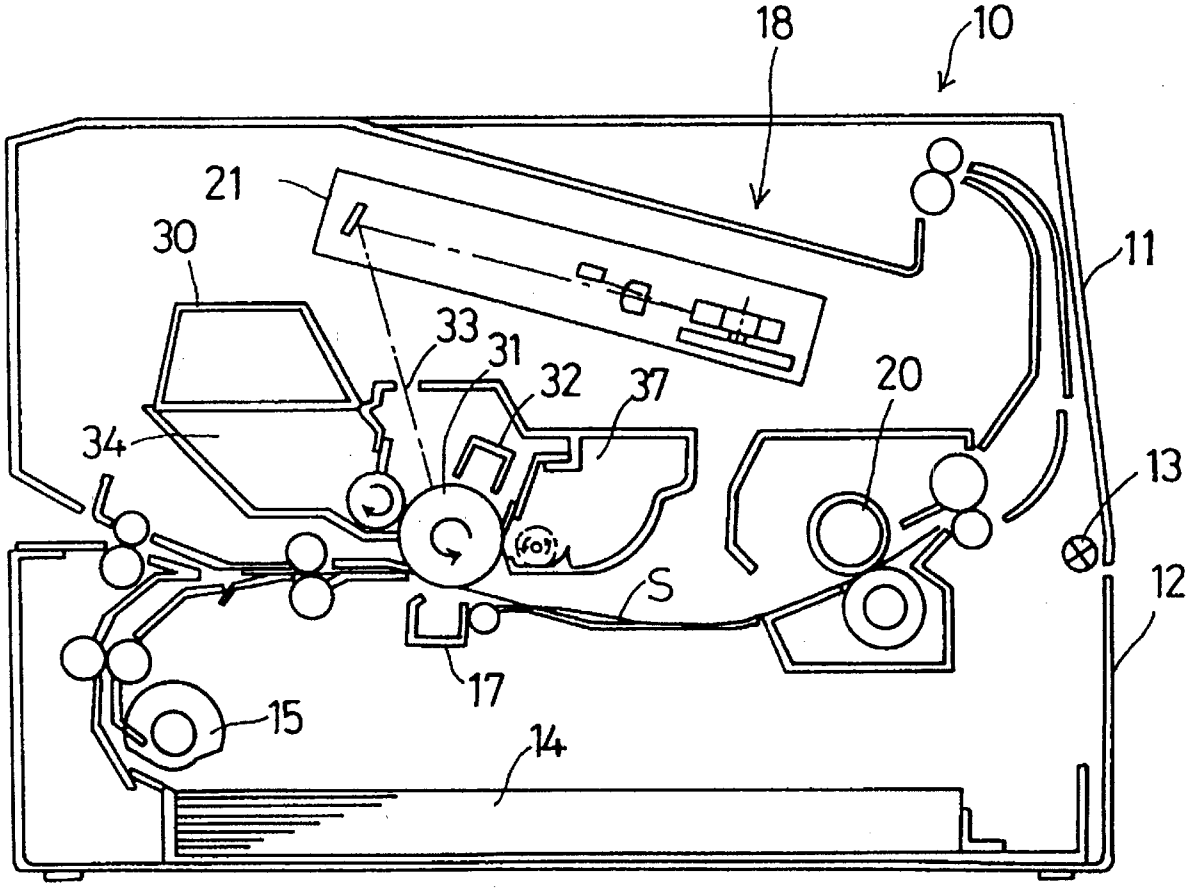
FIG. 1 is a schematic view of a laser printer embodying the invention.
Figure 2:
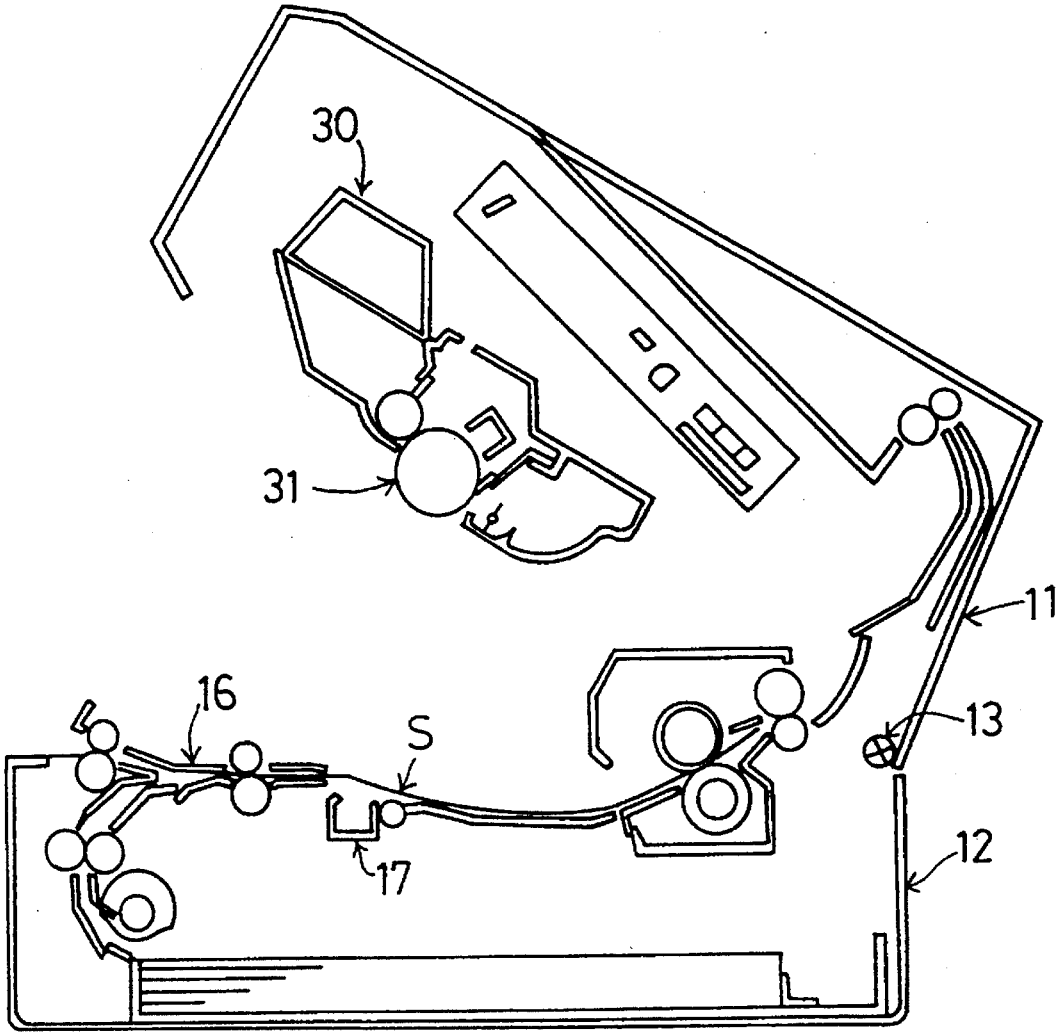
FIG. 2 is a schematic view of the embodiment of FIG. 1 with the upper and lower housings held open.

FIGS. 1 and 2 schematically show how the laser printer is constructed. In these views, the enclosure of the laser printer 10 is divided into an upper housing 11 and a lower housing 12, the upper housing 11 being pivotally opened and closed around a support shaft 13. The upper housing 11 comprises a process unit 30 for image formation; a scanner unit 21 that takes a laser beam, coming from a laser diode and modulated by an image recording signal, and scans a drum 31 with the laser beam to expose the drum 31. The laser beam is applied using a polygon mirror or the like. A paper stack tray 18 receives and holds the printed sheets of paper. The lower housing 12 comprises a paper feed cassette 14, containing unused sheets of papers; a paper feed roller 15; a paper transport path 16; a transfer charger 17 that transfers images from the drum 31 to the paper sheets S; and a toner fixing unit 20 that fixes the transferred toner onto the sheet.

The process unit 30 includes as its major components the drum 31, that acts as a photosensitive body; a primary charger 32, that charges the drum 31 uniformly; an exposure aperture 33, through which the drum 31 is scanned by the laser beam; a developing unit 34, that develops electrostatic latent images on the drum 31 into visual images using toner; and a cleaning unit 37 that recovers the residual toner from the drum 31 after toner transfer by the transfer charger 17 onto a paper sheet S. The process unit 30 is removably attached to the upper housing 11 of the laser printer 10 by use of a support frame (not shown).

The toner contained in the developing unit 34 of the process unit 30 is consumed through image transfer onto paper sheets S. The residual toner that is not transferred is collected in the cleaning unit 37. Through the repeated printing process, the charging and exposure characteristics of the drum 31 gradually deteriorate. For example, an OPC (organic photoconductor) drum 31 with a diameter of 30 mm has a service life of between 3,000 and 5,000 printed sheets. Thus it is necessary to replace or replenish such consumables at a predetermined frequency (i.e., at intervals of a predetermined number of printed sheets). This embodiment uses an integral type process unit that integrally contains various process means so as to minimize the chores of replacement and to prevent the spilling of the residual toner upon replacement.

The integral type process unit is designed so that the service life of the drum 31; the service life of the developing unit 34, determined by its capacity for holding toner; and the service life of the cleaning unit 37, determined by the capacity of its residual toner container, will approximately coincide with one another. When these components reach the end of their service lives, the process unit 30 as a whole is replaced with a new process unit 30. This minimizes the chores of unit replacement.

If the laser printer 10 is jammed during printing or when the process unit 30 is to be replaced, the upper housing 11 is pivotally opened, around the support shaft 13, from lower housing 12 to split the enclosure in two along the paper transport path 16 as shown in FIG. 2. This allows the jammed paper sheet S to be removed or the process unit 30 to be replaced.

Figure 3:
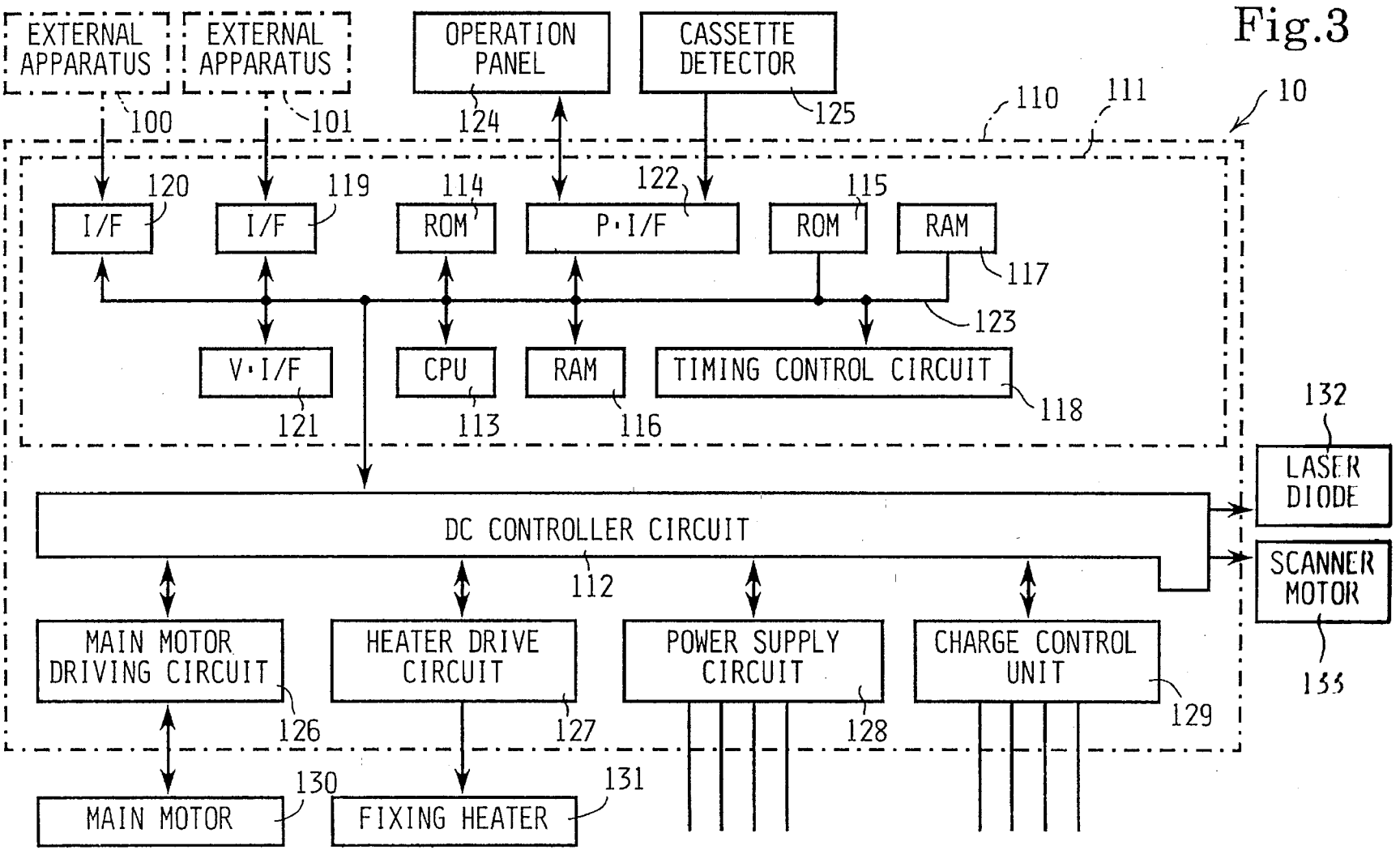
FIG. 3 is an electrical block diagram of the embodiment.

The electrical structure of the laser printer 10 will be described with reference to FIG. 3. A control unit 110 of the laser printer 10 has a video controller 111 and a DC controller circuit 112. The video controller 111 comprises a CPU 113; a ROM 114 that contains a print control program, a recovery information print control program (described later), two print control language interpreters A and B for printing the print data fed from external devices 100 and 101, and other control programs; a ROM 115 that stores outline data defining the outlines of a large number of characters and numerals; a RAM 116 with power backup which stores a predetermined amount of externally supplied print data and which includes an area for recording the number of times the laser printer 10 operates; a RAM 117 used as a work memory including a region for storing the dot data prepared on the basis of the data held in the RAM 116; a timing control circuit 118 that generates timing signals for writing and reading data to and from the RAM 116; two interfaces 119 and 120 (e.g., of RS422A and Centronics specifications) that receive print data such as character and image data from the external devices 100 and 101; a video interface 121 which is a dual port RAM made of two scan buffers of 4 kilobytes and which supplies the DC controller circuit 112 consecutively with print information converted to dot data format; and a panel interface 122 that receives signals from a control panel 124 and a cassette detector 125 for detecting the type of paper cassette that is currently loaded. The video controller components are interconnected via a bus 123 such as a data bus.

Figure 4:
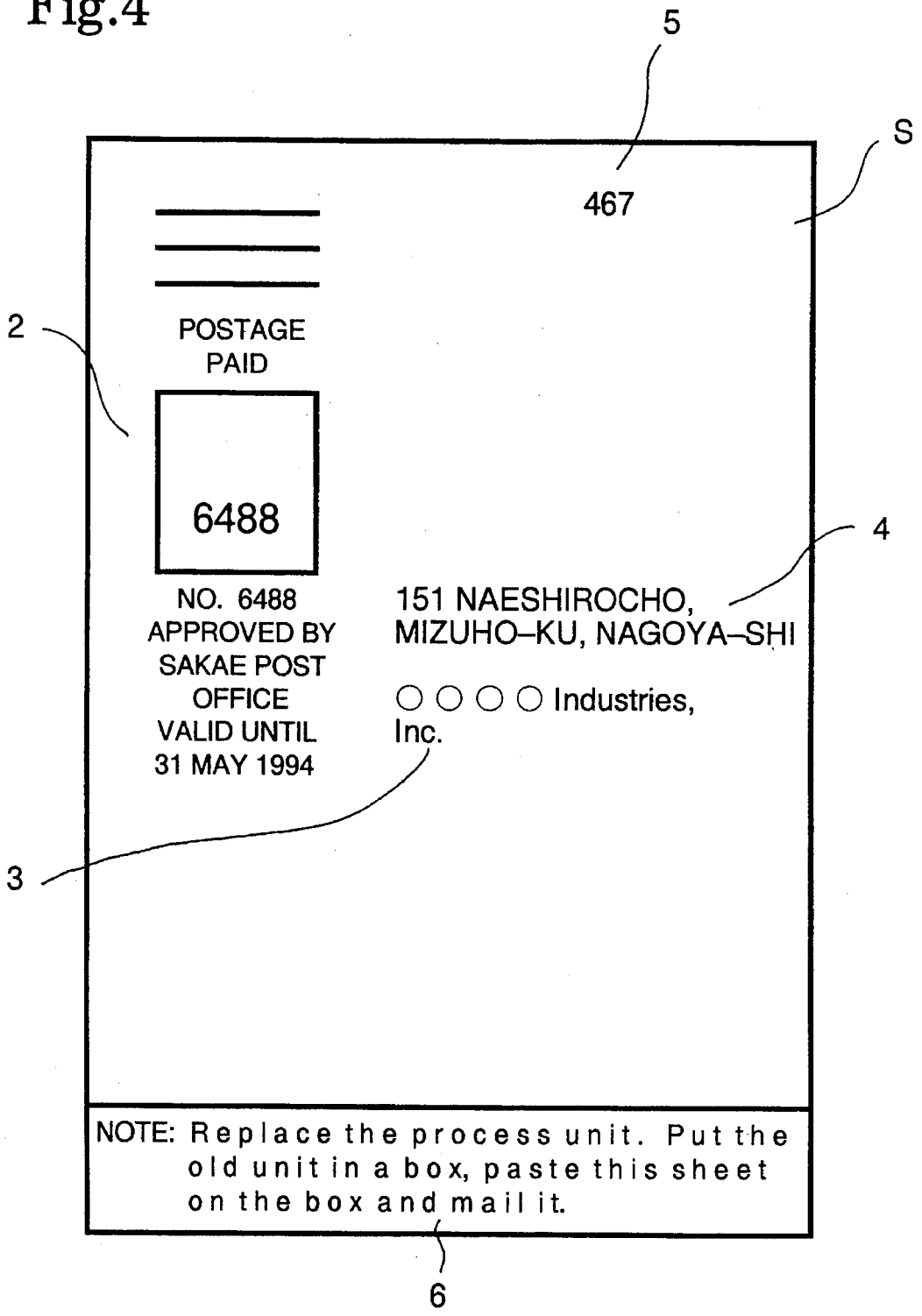
FIG. 4 is a printout example showing typical recovery information furnished by the embodiment.

The ROM 114 also contains print data that defines recovery information as shown in FIG. 4. The recovery information is formed illustratively by an officially approved "postage paid" mark 2 indicating that the postage is paid by the recipient of the mail, the recipient's name 3, the recipient's address 4, the postal code 5 applicable to the receiver's address 4, and a notice 6 for the user. The information is printed on a sheet S by the laser printer 10.

The DC controller circuit 112 is connected inside the control unit 110 to a main motor driving circuit 126 that drives a main motor 130 for rotating the drum 31; a heater driving circuit 127 that drives a toner fixing heater 131; a power supply circuit 128; and a charge control unit 129 that supplies high voltages to the transfer charger 17 and primary charger 32. The DC controller circuit 112 is also connected to a semiconductor laser diode 132 that acts as a light emitting element and to a scanner motor 133 that rotates the polygon mirror (e.g., hexahedron mirror) at high speed.

Figure 5:
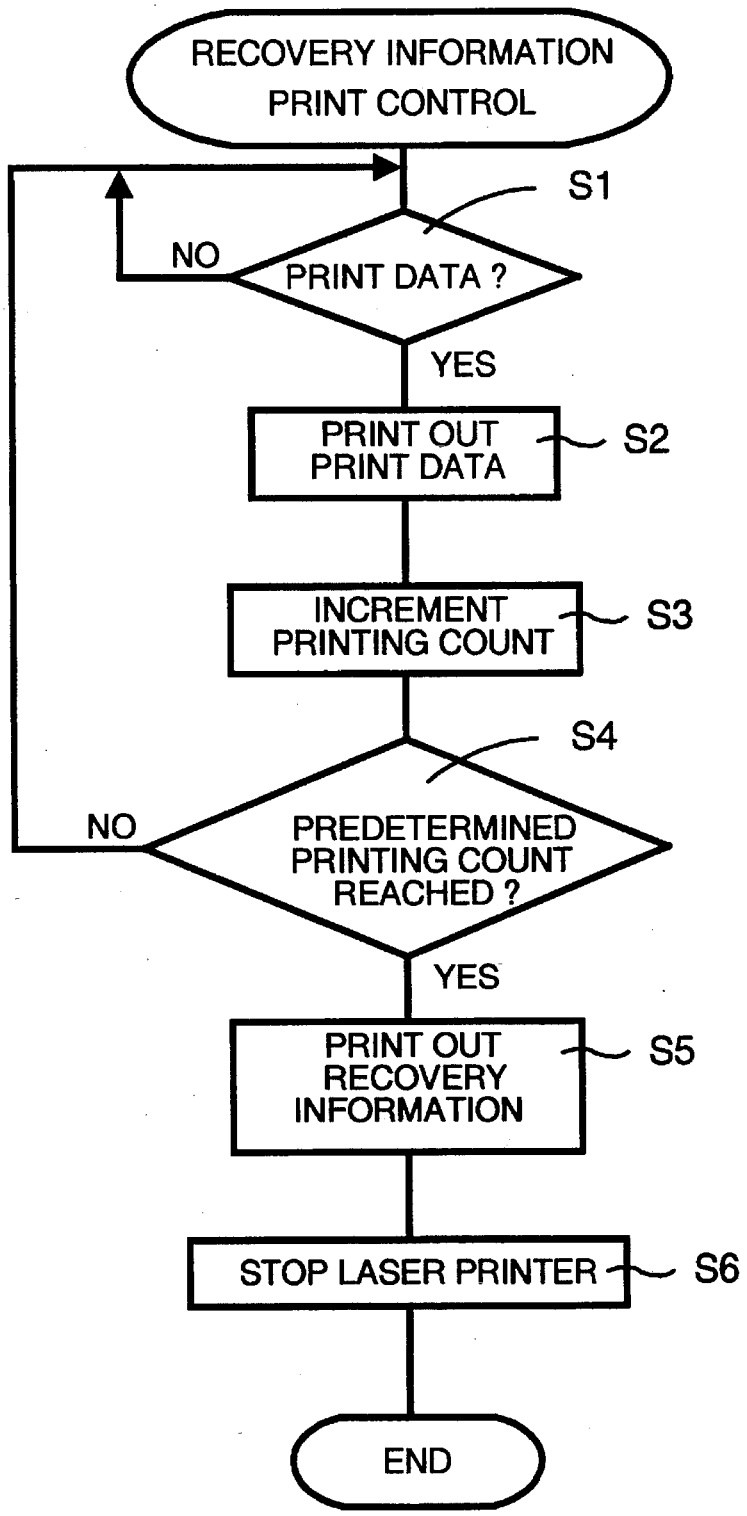
FIG. 5 is a flowchart of the operational steps of the embodiment.

How the laser printer 10 prints the recovery information will be described with reference to the flowchart of FIG. 5. When a new process unit 30 is installed, the CPU 113 detects the replacement and resets the print count recording area in the RAM 118 according to the appropriate control program in the ROM 114.

The laser printer 10 receives, from the external devices 100 and 101, print data such as character and image data through the interfaces 119 and 120. When the received data are verified in step 1 to be print data, the data are printed in step 2 on a sheet S by activation of the process unit 30 and other components. The print operation is the same as that of ordinary laser printers and will not be further discussed. In step 3, the area in the RAM 116 containing the printing count is incremented. At this point, the incremented value is equal to the number of sheets printed. In step 4, a check is made to see if the value in the printing count area in the RAM 116 has reached a predetermined value. If the predetermined value has not been reached, steps 1 through 4 are repeated for another print operation.

If the predetermined value has been reached, step 5 is entered. In step 5, the recovery information is printed on a paper sheet S in accordance with the print data representing the recovery information contained in the ROM 114. In step 6, the laser printer 10 is stopped. The number of sheets printed at this time is equal to the predetermined value and the process unit 30 has reached the end of its service life. For this embodiment, the value is set to be 5,000 sheets.

The user reviews the paper sheet S bearing the recovery information output by the laser printer 10. The printed notice 6 tells the user that the service life of the process unit 30 has expired and that the unit 30 is a consumable component to be recovered for recycling. The official "postage paid" mark 2, the recipient's name 3, the recipient's address'4 and the recipient's postal code 5 inform the user of where the article is to be returned and the manner of return.

The user then replaces the process unit 30 by opening the upper housing 11 from the lower housing 12 along the paper transport path 16, as shown in FIG. 2. The old process unit 30 is placed in a suitable box to which the paper sheet S bearing the recovery information is pasted. The box is then mailed to the printed address.

As described, the embodiment of the invention prints on the paper sheet S the recovery information such as the official "postage paid" mark 2, the recipient's name 3, the recipient's address 4 and the recipient's postal code 5 when the service life of the process unit 30 expires. The printed information allows the process unit 30 to be recovered easily through the mail, with a minimum of cost and effort required of the user. This scheme drastically enhances the probability of recovery of the process unit 30.

The image formation apparatus according to the invention thus provides printed information at predetermined intervals about the consumables thereof to be recovered, the information clearly indicating where the consumables are to be sent and in what manner. The apparatus is a significant improvement over its prior art counterparts in terms of the rate of recovery of consumables.

Although the counting means of the invention comprises the CPU 113 and RAM 116 in the above described embodiment, this is not limitative of the invention. Alternatively, the counting means may be an electrical or mechanical counter.

As many apparently different embodiments of this invention may be made without departing from the spirit and scope thereof, it is to be understood that the invention is not limited to the specific embodiments thereof except as defined in the appended claims.

What is claimed is:

1. A printing apparatus for forming images on a photosensitive surface and transferring the images onto a recording material, that facilitates the recycling of components at an end of their useful life comprising:

at least one element having a predetermined operational life;

first storage means for storing data including that of the predetermined operational life of said at least one element and return information concerning where to send said at least one element at an end of the predetermined operational life;

keeping means for keeping track of an operational life of said at least one element; and control means for causing the printing apparatus to print appropriate return information as a return label containing a receiver name and a receiver address when said at least one element reaches the end of the predetermined operational life.

2. The printing apparatus is claimed in claim 1, wherein said keeping means is a counting means for counting the number of times images are recorded.

3. The printing apparatus is claimed in claim 2, wherein said predetermined operational life of said at least one element is defined in terms of a maximum number of images that may be recorded and when said counting means counts a number equal to the maximum number, said control means causes a printing of the appropriate return information.

4. The printing apparatus is claimed in claim 1, wherein said return information further comprises:

an approved postage paid mark; and instructions for an operator.

5. The printing apparatus is claimed in claim 1, wherein said at least one element comprises a process unit.

6. The printing apparatus is claimed in claim 5, wherein said process unit includes at least one of a group comprising:

a drum which acts as a photosensitive body;

a primary charger for charging the said drum uniformly;

a developing unit containing toner for developing electrostatic latent images on said drum into visual images; and a cleaning unit for recovering residual toner from said drum.

7. The printing apparatus as claimed in claim 1, wherein said recording material is a printing sheet and said first storage unit stores at least one of a group of data comprising data of the predetermined operational life of a drum, a developing unit for holding toner and a cleaning unit, the predetermined operational lives of these elements being expressed in numbers of printed sheets.

8. The printing apparatus as claimed in claim 2, further comprising a second storage means, wherein the results from said counting means are stored in said second storage means.

9. A method for facilitating recycling of components of a printing apparatus at an end of their useful life, comprising the steps of:

identifying recyclable components;

determining a measure of the useful life of at least one of said recyclable components;

storing the measure of the useful life of said at least one recyclable component in a memory means of the printing apparatus;

maintaining a record of use of said at least one recyclable component in terms comparable to the measure of the useful life of said at least one recyclable component;

determining when a value of the record equals the measure; and printing recovery information when the value of the record equals the measure wherein the step of printing recovery information comprises printing a return label containing:

a receiver name; and a receiver address.

10. The method as claimed in claim 9, further comprising the steps of:

stopping the printing apparatus after the printing step; and replacing the recyclable component that has reached the end of useful life.

11. The method as claimed in claim 10, further comprising the steps of enabling printing when the recyclable component that has reached the end of useful life has been replaced.

12. The method as claimed in claim 9, further comprising the steps of:

stopping the printing apparatus after the printing step; and overriding stopping the printing.

13. The method as claimed in claim 9, wherein the measure is a predetermined number of sheets printed and the record of use is a count of an actual number of sheets printed.

14. The method as claimed in claim 9, wherein the measure is a predetermined operational time period and the record of use is a clock count of expired operational time.

15. The method as claimed in claim 10, wherein the step of printing recovery information further comprises printing instructions for an operator and can include an approved postage paid mark.

16. A printing apparatus that facilitates the recycling of components at an end of their useful life, comprising:

means for storing a measure of the useful life of at least one recyclable component;

means for maintaining a record of use of said at least one recyclable component in terms comparable to the measure of the useful life of said at least one recyclable component;

means for determining when a value of the record equals the measure; and means for printing recovery information when the value of the record equals the measure, wherein the means for printing recovery information prints a return label containing:

a receiver name; and a receiver address.

17. The printing apparatus as claimed in claim 16, further comprising:

means for stopping the printing apparatus after printing the recovery information.

18. The printing apparatus as claimed in claim 17, further comprising means for enabling printing when the recyclable component that has reached the end of useful life has been replaced.

19. The printing apparatus as claimed in claim 16, further comprising:

means for stopping the printing apparatus after printing the recovery information; and means for overriding stopping the printing.

20. The printing apparatus as claimed in claim 16, wherein the means for printing recovery information further prints instructions for an operator and may print an approved postage paid mark.

* * * * *